US005228695A

United States Patent [19]

Meyer

[11] Patent Number: 5,228,695

[45] Date of Patent: Jul. 20, 1993

[54] GOLF CLUB INCLUDING ALIGNMENT DEVICE

[75] Inventor: Dean E. Meyer, LaGrange Park, Ill.

[73] Assignee: Wilson Sporting Goods Co., Chicago, Ill.

[21] Appl. No.: 921,726

[22] Filed: Jul. 30, 1992

[51] Int. Cl.[5] ..... A63B 69/36

[52] U.S. Cl. ..... 273/187.4; 273/163 A; 273/81 B

[58] Field of Search ..... 273/164.1, 163 A, 81 B, 273/171, 187.4, 163 R, 164.2, 186.2, 187.5, 187.6

[56] References Cited

U.S. PATENT DOCUMENTS

| | | | |
|---|---|---|---|
| 719,771 | 2/1903 | Evans | 40/454 X |
| 1,216,208 | 1/1915 | Hayford | 273/163 A |
| 1,475,430 | 11/1923 | Curwen | 40/454 |
| 2,833,176 | 5/1958 | Ossoinak | 40/454 X |
| 3,225,457 | 12/1965 | Schure | 40/454 X |
| 3,468,545 | 9/1969 | Anderson | 273/164.1 X |
| 3,520,588 | 7/1970 | Salyer | 430/946 X |
| 3,538,632 | 11/1970 | Anderson | 40/454 X |
| 3,549,300 | 12/1970 | Pelz | 273/162 |
| 3,582,329 | 6/1971 | Ivanov et al. | 40/946 X |
| 3,775,110 | 11/1973 | Bestenreiner et al. | 430/946 X |
| 4,327,916 | 5/1982 | Shiratori | 273/163 A |
| 4,340,229 | 7/1982 | Stuff | 273/164 |
| 4,569,525 | 2/1986 | Folger | 273/81 B X |
| 4,749,196 | 6/1988 | Podgor | 273/164.2 |
| 4,884,813 | 12/1989 | Cates | 273/163 A X |
| 5,026,062 | 6/1991 | Freeberg | 273/187.5 |
| 5,152,533 | 10/1992 | Radakovich | 273/81 B X |
| 5,158,297 | 10/1992 | Johnson | 273/81 B X |

*Primary Examiner*—George J. Marlo

[57] ABSTRACT

A golf club is provided with an alignment device for indicating when the face of the club is properly aligned. The alignment device comprises a linearoptic screen or lenticular decal which provides a three-dimensional indicator, such as a line which appears below the top surface of the screen, for indicating when the face is aligned.

9 Claims, 2 Drawing Sheets

GOLF CLUB INCLUDING ALIGNMENT DEVICE

BACKGROUND

This invention relates to golf clubs, and, more particularly, to an alignment aid for indicating when a golf club is properly aligned.

A golf club, for example, an iron type of golf club, includes a hitting face for striking a golf ball. If the golf club is to hit the golf ball accurately, the hitting face must be properly aligned with the intended line of flight of the ball. For a straight shot, i.e., a shot for which the player does not intend to impart draw or fade spin to the ball, the club face must be aligned square to the target line. The club face of an iron is square to the target line when the plane of the face is perpendicular to a vertical plane along the target line. The face of a wood type of golf club conventionally includes bulge and roll curvature, and a wood club is square to the target line when a plane which is tangent to the center of the face is perpendicular to a vertical plane along the target line.

Many golfers, particularly beginning golfers, have difficulty in determining when a golf club is properly aligned. Even accomplished golfers periodically experience problems with alignment. Because a player is standing to one side of the target line and cannot look down the target line when he addresses the golf ball, it is difficult to determine when the club face is square. If the player intends to "work" the ball by closing or opening the face of the club at address, it is difficult to determine the degree to which the club face is closed or open relative to the target line. The problem of alignment is such that many golfers cannot be sure that the club face is properly aligned without the assistance of another person who stands behind the player along the target line and observes the position of the club face.

SUMMARY OF THE INVENTION

The invention provides a simple alignment device which is mounted on the golf club and which enables the golfer to determine when the club face is properly aligned without the assistance of another person. The alignment device comprises a linearoptic or lenticular screen which provides a three-dimensional visual image of an indicating mark below the surface of the screen. When the position of the screen changes relative to the golfer's eyes, the position of the indicating mark changes at a magnified rate, thereby providing a readily apparent indication of the position of the club face. In one embodiment of the alignment device the screen provides the image of a line which is aligned with lines on the club above and below the screen when the club face is aligned square to the target. When the club shaft and club face are rotated slightly out of alignment, the line on the screen moves out of alignment with the lines on the club. In another embodiment of the alignment device no image is visible on the screen when the club face is properly aligned, but an indicating mark or color becomes visible if the club is rotated out of alignment in either direction.

DESCRIPTION OF THE DRAWINGS

The invention will be explained in conjunction with illustrative embodiments shown in the accompanying drawing, in which.

DESCRIPTION OF SPECIFIC EMBODIMENT

Figure 1:
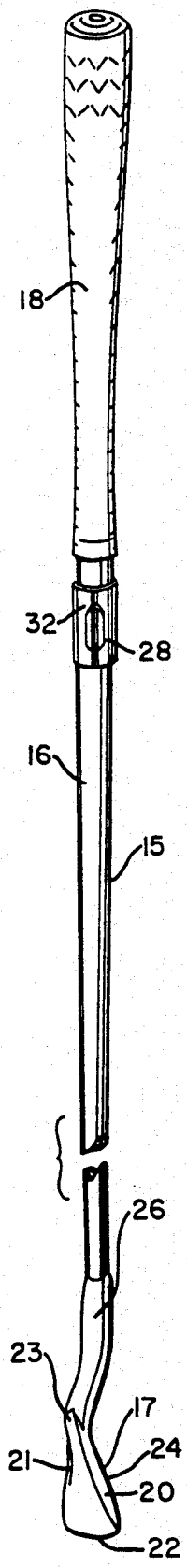
FIG. 1 is an elevational view of a golf club equipped with an alignment device in accordance with the invention.
Figure 2:
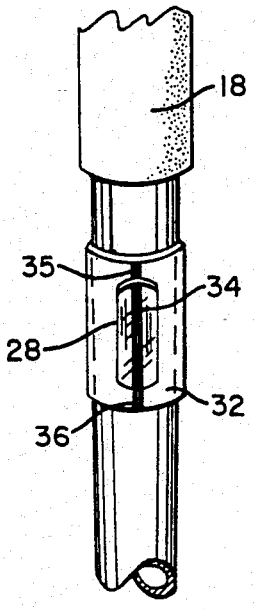
FIG. 2 is an enlarged fragmentary view of a portion of the golf club of FIG. 1.
Figure 3:
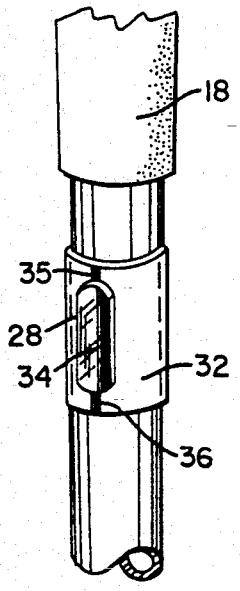
FIG. 3 is a view similar to FIG. 2 showing the golf club rotated clockwise.
Figure 4:
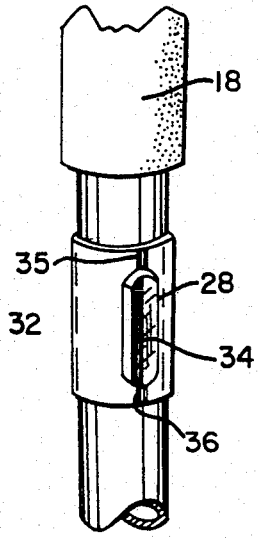
FIG. 4 is a view similar to FIG. 2 showing the golf club rotated counterclockwise.

Referring to FIGS. 1–4, a conventional iron-type golf club 15 includes an elongated shaft 16 and a club head 17 mounted on the lower end of the shaft. A grip 18 is mounted on the upper end of the shaft.

The club head 17 includes a front face or striking face 20, a rear face 21, a sole 22, a toe 23, and a heel 24. The front face 20 is provided with grooves or square lines 25 (see also FIG. 9). The particular club head illustrated also includes a hosel 26 which is connected to the shaft 16.

An alignment device 28 is mounted on the shaft 16 just below the grip 18. The particular alignment device illustrated is a linearoptic or lenticular screen. Such devices are well known and provide a three dimensional image which changes position and/or color depending upon the angle at which the screen is viewed. Linearoptic screens are available from Optigraphics Corp., 924 Avenue J East, Grand Prairie, Tex. 75050 under the name Magic Motion and are described in U.S. Patent Nos. 2,833,176, 3,225,457, 3,538,632, 3,520,588, 3,582,329, and 3,775,110.

Briefly, a linearoptic screen which consists of numerous tiny lenses which are laminated in register to a film which is imprinted with multiple images. Each of the lenses focuses on a different portion of the printed image, and as the angle of view of the screen changes, the position of the image changes.

Figure 5:
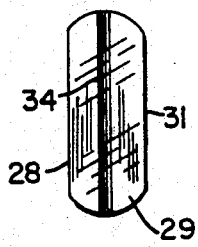
FIG. 5 is a plan view of the alignment device.
Figure 6:
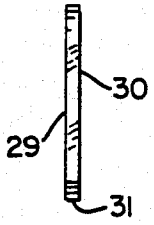
FIG. 6 is a side elevational view of the alignment device.

The linearoptic screen 28 is flat and includes a front face 29 (FIGS. 5 and 6) which faces away from the shaft of the golf club, a rear face 30 which faces toward the golf club, and a generally rectangular side surface 31. The screen is adhesively mounted on a strip of adhesive tape 32, and the adhesive tape is wrapped around the shaft 16.

The graphics of the linearoptic screen 28 provides the image of a straight line 34 when the sight line from the observer to the screen is perpendicular to the front face 29. A pair of straight lines 35 and 36 are imprinted on the tape 32 above and below the screen. The screen is mounted on the shaft so that when a golfer holds the club at address, he sees the indicating line 34 aligned with the lines 35 and 36 when the club face is square to the target line (see FIG. 2). If the club face is rotated out of the square position, the indicating line 34 moves out of alignment with the lines 35 and 36 (see FIGS. 3 and 4).

The lenses of the linearoptic screen 28 provide a three dimensional depth to the image of the line 34, and the line appears to be below the plane of both the front face 29 and rear face 30 of the screen and also below the level of the lines 35 and 36 on the tape 32. The lenses of the linearoptic screen also magnify the movement of the indicating mark 34 relative to the movement of the screen 28 so that a small movement of the screen relative to the viewer causes a greater movement of the indicating line relative to the viewer. Even a small movement of the club out of the square position is therefore readily apparent by movement of the indicating line 34 away from the lines 35 and 36.

The indicating line can be used not only to indicate to the golfer when the club face is square to the target line at address but also to provide an indication of the degree to which the club face is open or closed at address. If the golfer desires to leave the club face open or closed at address in order to spin the ball, the degree to which the club face is open or closed is indicated by the degree of misalignment of the indicating mark 34 and the lines 35 and 36.

Figure 8:
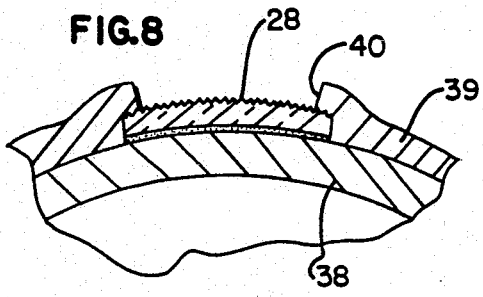
FIG. 8 is an enlarged fragmentary sectional view taken along the line 8—8 of FIG. 7.
Figure 7:
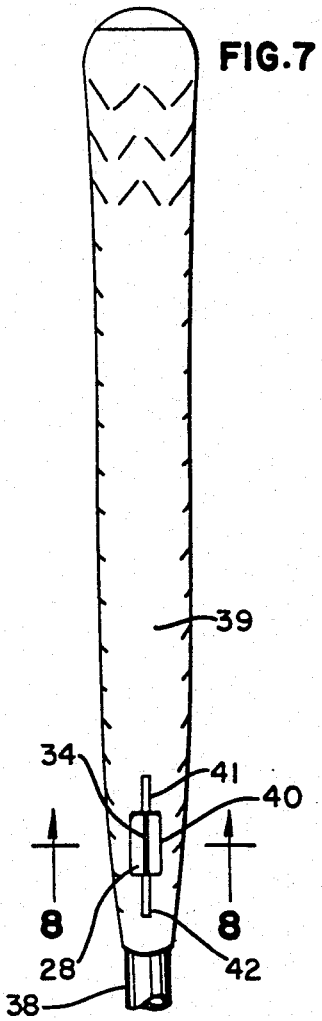
FIG. 7 illustrates a modified embodiment of the alignment device wherein the alignment device is mounted within the grip of the golf club.

FIGS. 7 and 8 illustrate the linearoptic screen 28 mounted on a club shaft 38 underneath a grip 39. The screen can be adhesively secured to the shaft, and the grip is provided with an opening 40 which exposes the front face of the screen. Lines 41 and 42 are imprinted on the grip and are aligned with the indicating line 34 of the screen when the club face is square to the target line.

Figure 9:
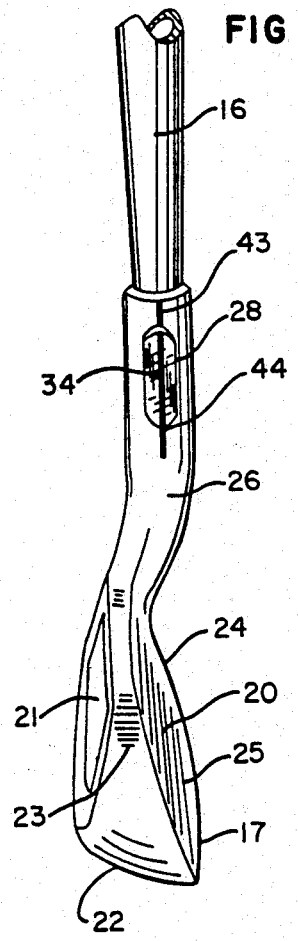
FIG. 9 is another embodiment of the alignment device in which the alignment device is mounted on the hosel of the club head.

In FIG. 9 the linearoptic screen 28 is mounted on the hosel 26 of the club head. Straight lines 43 and 44 are imprinted or etched on the hosel and are aligned with the indicating line 34 of the linearoptic screen when the club face is square to the target line.

Figure 10:
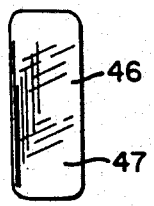
FIG. 10 is a plan view of an alignment device in which no indicating mark is visible when the club is properly aligned.
Figure 11:
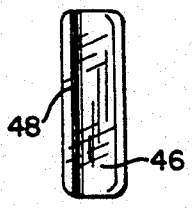
FIG. 11 illustrates the alignment device of FIG. 10 which is rotated clockwise from the FIG. 10 position, thereby bringing an indicating mark into view.
Figure 12:
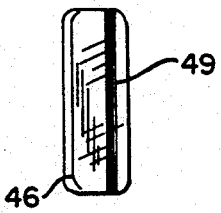
FIG. 12 illustrates the alignment device of FIG. 10 in which the alignment device is rotated counterclockwise from the FIG. 10 position, thereby bringing an indicating mark into view.

FIGS. 10–12 illustrate a linearoptic screen 46 which is similar to the linearoptic screen 28 except that the screen does not provide an image when the observer views the screen perpendicularly to the front face 47 of the screen as illustrated in FIG. 10. When the screen is rotated slightly clockwise as illustrated in FIG. 11, an indicating line 48 moves into view from the left edge of the screen. When the linearoptic screen is rotated counterclockwise slightly from its FIG. 10 position, an indicating line 49 moves into view from the right edge of the screen.

Figure 13:
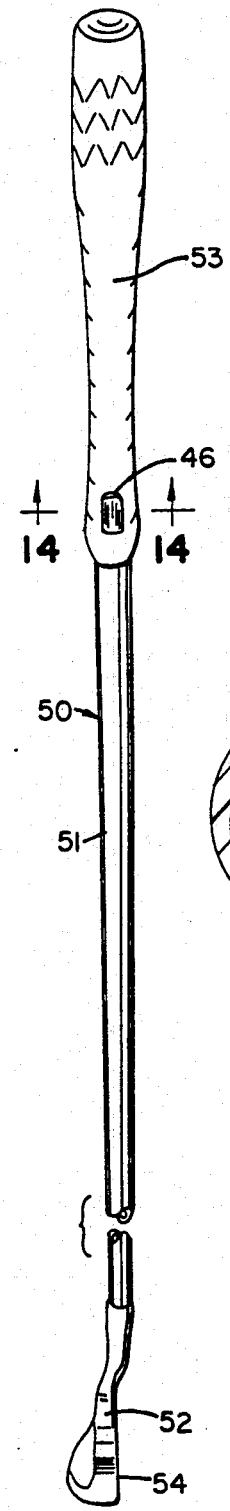
FIG. 13 is an elevational view of a putter which is equipped with an alignment device on the grip.
Figure 14:
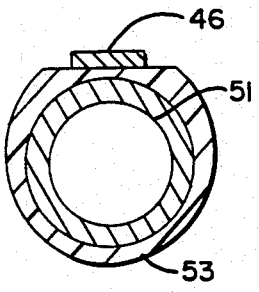
FIG. 14 is an enlarged sectional view taken along the line 14—14 of FIG. 13.

FIG. 13 illustrates the linearoptic screen 46 mounted on a putter 50. The putter includes a shaft 51, a putter head 52, and a grip 53. The linearoptic screen 46 is adhesively mounted on the lower portion of the grip 53, although the screen could be mounted on the shaft or the hosel. When the face 54 of the putter head is perpendicular to the target line, the golfer does not see any indicating line in the linearoptic screen 46. However, if the face of the putter is rotated slightly out of line, one of the lines 48 and 49 will come into view and indicate to the golfer that the face is out of alignment. The printed sheet of the linearoptic screen can be printed to provide other indicating images to the golfer. For example, the linearoptic screen can provide one color, for example, green, when the club face is properly aligned and another color, for example, red, when the club face is out of alignment.

Even if the alignment aid is not allowed to be used by the rules which are applicable to a particular golf event, the alignment aid is useful as a practice and training device. By using the alignment device, a golfer can become accustomed to the proper position of the club face when the club face is aligned. He can thereafter rely on that position of the club face as assurance that the club face is properly aligned even when the alignment device is not mounted on the club.

While in the foregoing specification a detailed description of specific embodiments of the invention was set forth for the purpose of illustration, it will be understood that many of the details herein given may be varied considerably by those skilled in the art without departing from the spirit and scope of the invention.

I claim:

1. In combination, a golf club and an alignment device mounted on the golf club, the golf club having an elongated shaft having upper and lower ends, a grip on the upper end of the shaft, and a club head attached to the lower end of the shaft, the club head having a face for striking ,a golf ball, the alignment device comprising a screen viewable by a golfer while addressing a golf ball and which provides indicating means for indicating when the face of the club head is aligned with the direction in which the ball is intended to be struck and said screen having a bottom surface which faces toward the golf club and a top surface which faces away from the golf club, said screen including lenses which provide a three-dimensional image of said indicating means so that the indicating means appears below the top surface of the screen.

2. The structure of claim 1 in which the club includes an alignment mark adjacent the screen, said indicating means comprising a line which is aligned with said mark when the face is properly aligned and which is offset from the mark when the face is not properly aligned.

3. The structure of claim 1 in which said indicating means comprises a mark which is visible when the face is not properly aligned and which is not visible when the face is properly aligned.

4. The structure of claim 1 in which said alignment device comprises a linearoptic screen having a plurality of lenses and an image behind the lenses for providing said indicating means.

5. The structure of claim 1 in which said screen is mounted on the shaft adjacent the grip.

6. The structure of claim 1 in which said grip is provided with an opening and said screen is mounted on the shaft and is exposed by the opening in the grip.

7. The structure of claim 1 in which said screen is mounted on the grip.

8. The structure of claim 1 in which said club head includes a hosel which connects the club head to the shaft, said screen being mounted on the hosel.

9. The structure of claim 1 in which the club includes an alignment mark adjacent the screen, said indicating means comprising a line which is aligned with said mark when the face is properly aligned and which is offset from the mark when the face is not properly aligned.

* * * * *